US007789090B2

(12) United States Patent
Tran

(10) Patent No.: US 7,789,090 B2
(45) Date of Patent: Sep. 7, 2010

(54) FINGERNAIL POLISH REMOVING DEVICE

(76) Inventor: Hai Minh Tran, 604 Farmington Blvd., Winchester, VA (US) 22602

( * ) Notice: Subject to any disclaimer, the term of this patent is extended or adjusted under 35 U.S.C. 154(b) by 181 days.

(21) Appl. No.: 11/701,491

(22) Filed: Feb. 2, 2007

(65) Prior Publication Data

US 2008/0185012 A1 Aug. 7, 2008

(51) Int. Cl.

| | |
|---|---|
| ***A45D 29/18*** | (2006.01) |
| ***A45D 29/05*** | (2006.01) |
| ***A45D 29/14*** | (2006.01) |
| ***A47L 1/02*** | (2006.01) |

(52) U.S. Cl. ..... 132/74.5; 132/73.6; 132/75.8; 15/97.1

(58) Field of Classification Search ..... 132/74.5, 132/75.8, 75.3, 73.5, 73
See application file for complete search history.

(56) References Cited

U.S. PATENT DOCUMENTS

| | | | | |
|---|---|---|---|---|
| 1,366,306 | A | 1/1921 | Wick | |
| 4,180,884 | A | 1/1980 | Hess et al. | |
| 4,255,826 | A | 3/1981 | Boyd | |
| 4,386,873 | A * | 6/1983 | Messner et al. | 405/36 |
| 4,800,606 | A * | 1/1989 | Kolesky | 15/97.1 |
| 4,875,246 | A * | 10/1989 | MacGregor | 15/98 |
| 5,007,441 | A * | 4/1991 | Goldstein | 132/73.6 |
| 5,185,900 | A | 2/1993 | Warner et al. | |
| 5,339,477 | A * | 8/1994 | Warner et al. | 15/97.1 |
| 5,379,474 | A | 1/1995 | Nakamura | |
| 5,823,203 | A | 10/1998 | Carroll et al. | |
| 6,575,171 | B1 | 6/2003 | Jacquin | |
| 2006/0150992 | A1 | 7/2006 | Nevakshonoff | |

* cited by examiner

*Primary Examiner*—Robyn Doan
(74) *Attorney, Agent, or Firm*—Stephen R. Greiner

(57) ABSTRACT

A fingernail polish removing device including a motor having an upwardly extending drive shaft. A drum is positioned above the motor and having an opening in the bottom thereof for receiving the drive shaft. A carriage is positioned within the drum and is secured to the drive shaft for rotation therewith. A sponge is supported for rotation by the carriage. The sponge has a circular band positioned around the drive shaft and a plurality of teeth pointing inwardly from the circular band toward the drive shaft. A handrest is positioned atop the drive shaft for supporting the hand of a user while her fingernails are extended downwardly into the drum and are engaged with the teeth. A wiper is secured to the to the drum and has a wiper bar disposed between the circular band and the drive shaft for sequentially compressing the teeth as the sponge is rotated by the carriage so as to squeeze dirty cleaning solution from the sponge for collection in the bottom of the drum.

3 Claims, 4 Drawing Sheets

FINGERNAIL POLISH REMOVING DEVICE

FIELD OF THE INVENTION

The present invention relates generally to toilet articles and, more particularly, to manicuring implements combined with motors.

BACKGROUND OF THE INVENTION

It has always been difficult for an individual to remove fingernail polish from her fingernails. It is a time-consuming process requiring the rubbing of cotton balls saturated with cleaning solution against each of the polished fingernails. A mess is often made as the cleaning solution dissolves the fingernail polish and the concentrated pigments in the fingernail polish start to run and drip. These pigments stain skin, clothing, porous countertops, and just about anything else that they contact. If this were not bad enough, the fibers forming the cotton balls tend to separate, stick to the skin of a user, and anchor suspended pigments. For these reasons, many women will travel to a salon and pay a professional a substantial fee to remove fingernail polish.

SUMMARY OF THE INVENTION

In light of the problems associated with the known process and apparatus for removing polish from fingernails, it is a principal object of the invention to provide a device that quickly removes polish from fingernails with a minimum of mess. A user need only place the fingers of one hand partially into the device and, within a few seconds, all five fingernails are simultaneously cleaned. The device can accommodate both small and large hands, making it "one size fits all."

It is another object of the present invention to provide a fingernail polish removing device of the type described that is substantially self-cleaning such that the device immediately withdraws dirty cleaning solution from contact with the fingers of a user. Thus, the device minimizes the likelihood that the fingers of a user will be stained as fingernail polish is removed.

It is a further object of the invention to provide a fingernail polish removing device of the type described that is battery-powered and is, therefore, portable and can be used practically anywhere including home and salon.

It is still another object of the invention to provide a fingernail polish removing device of the type described that can be used with minimal instruction and no additional tools or accessories. Thus, solution-soaked cotton balls are a thing of the past when my device is employed.

It is an additional object of the invention to provide a fingernail polish removing device of the type described that also removes artificial fingernails made of acrylic or silk.

It is an object of the invention to provide improved features and arrangements thereof in a fingernail polish removing device for the purposes described that is lightweight in construction, inexpensive to manufacture, and dependable in use.

Briefly, the fingernail polish removing device in accordance with this invention achieves the intended objects by featuring a base having a hollow, upwardly extending spindle. An electric motor is positioned within the base and has a drive shaft extending upwardly through the hollow spindle. A drum is removably positioned upon the base. The drum has an opening in its bottom and a sleeve extending upwardly from the periphery of the opening for receiving the spindle. A carriage is positioned within the drum and is secured to the top of the drive shaft for rotation therewith. A sponge is supported for rotation by the carriage. The sponge has a circular band positioned around the sleeve and a plurality of teeth pointing inwardly from the circular band. A handrest is positioned atop the drive shaft for supporting the hand or a user while her fingernails are extended downwardly into the drum and engaged with the teeth. A wiper is secured to the drum and has a wiper bar for compressing the teeth as the sponge is rotated to squeeze dirty cleaning solution from the sponge for collection in the bottom of the drum. A container for holding fingernail cleaning solution is secured to the base and is positioned adjacent to the drum. An electric pump is connected to the container for drawing fingernail cleaning solution from the container. A spout is connected to the pump and is positioned above the sponge for delivering cleaning solution to the teeth. A battery is selectively connected to the motor and the pump for energizing same.

The foregoing and other objects, features, and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
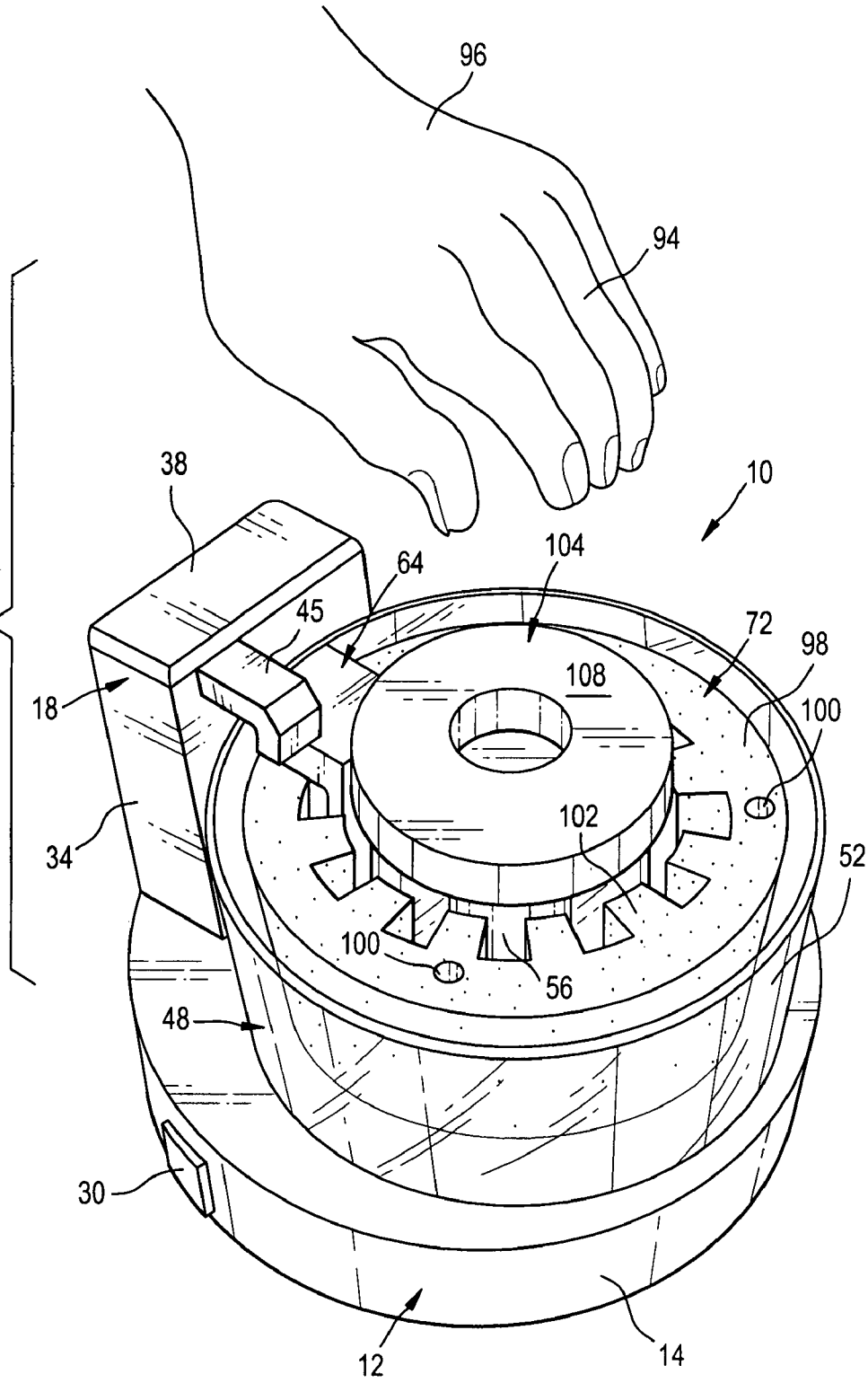
FIG. 1 is a perspective view of a fingernail polish removing device in accordance with the present invention.
Figure 2:
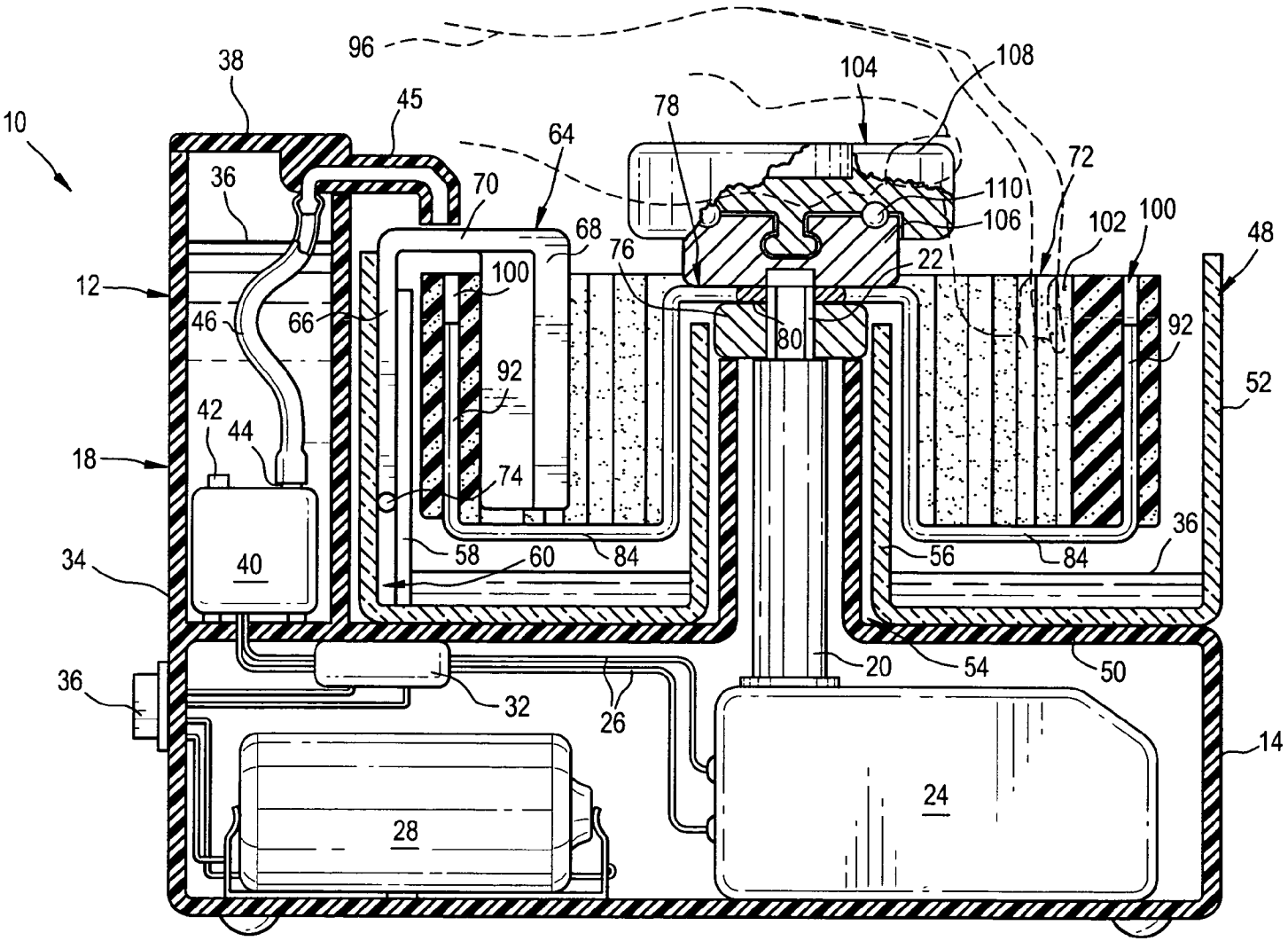
FIG. 2 is a cross-sectional view of the fingernail polish removing device of FIG. 1.
Figure 3:
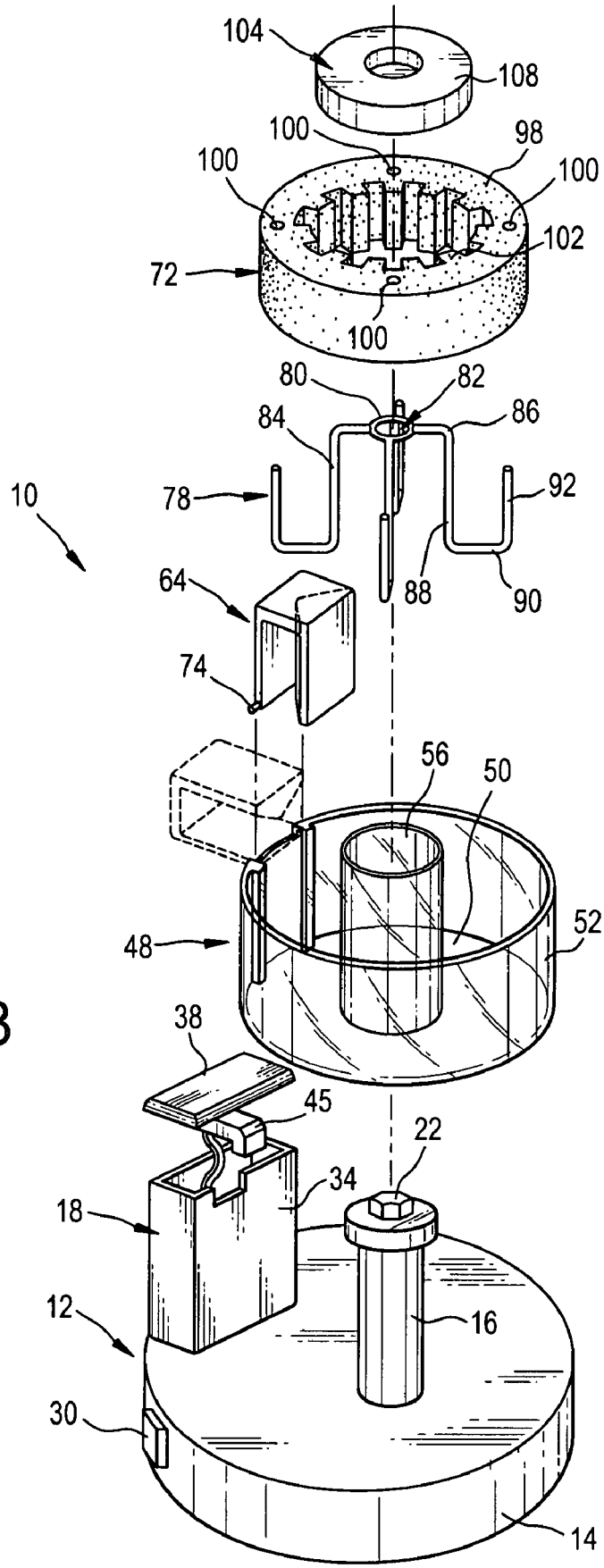
FIG. 3 is an exploded perspective view of the fingernail polish removing device.
Figure 4:
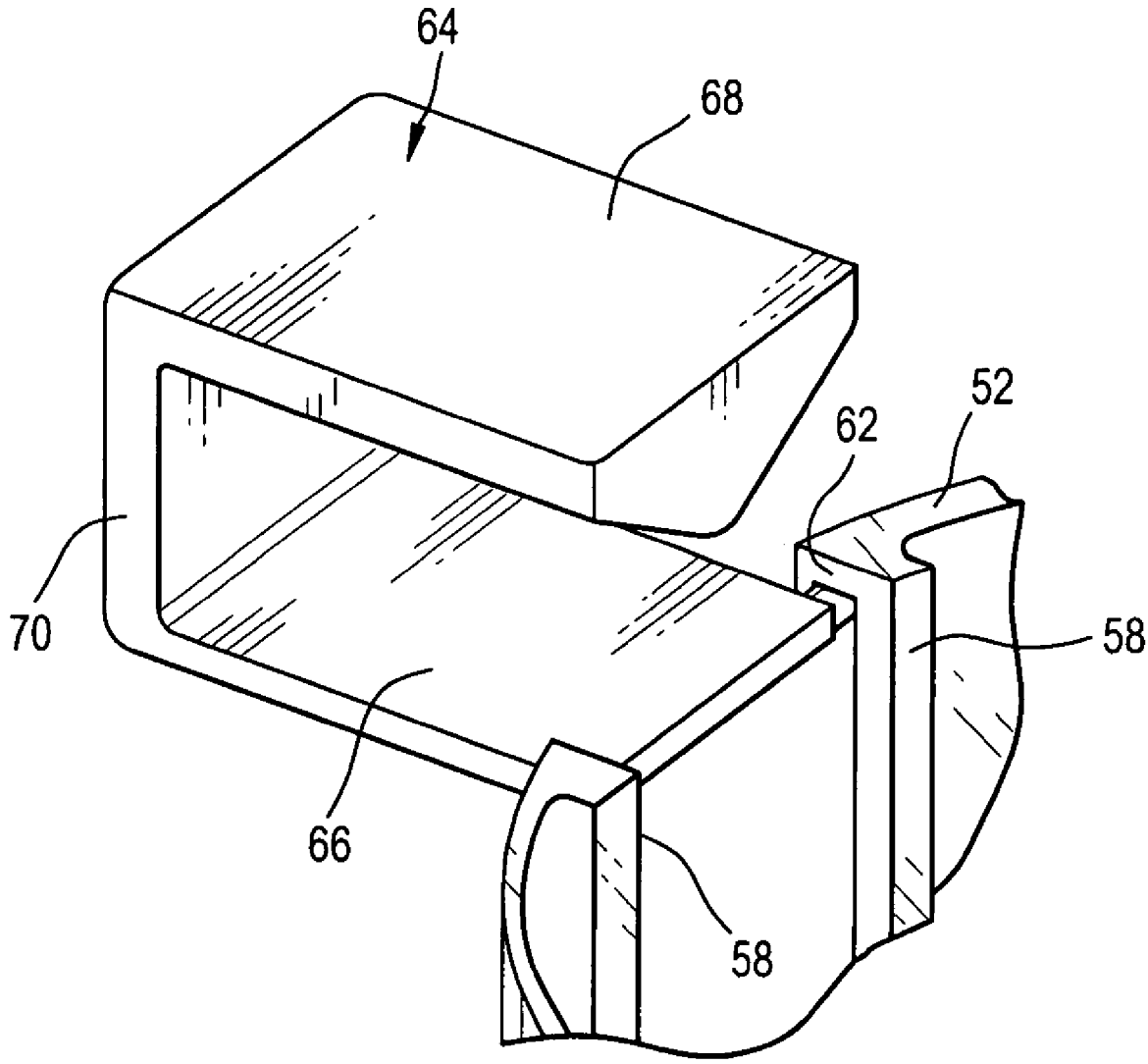
FIG. 4 is a perspective view of a portion of the drum of the fingernail polish removing device.

Referring now to the FIGS., a fingernail polish removing device in accordance with the present invention is shown at 10. Device 10 includes a base 12 having a housing 14 with a hollow spindle 16 that projects upwardly from the center of housing 14 and a fluid reservoir 18 that projects upwardly from one side of housing 14. A drive shaft 20, having a polygonal key 22 at its top, extends through spindle 16 and is rotated by an electric motor 24 mounted within housing 14. Motor 24 is connected by electrical leads 26 to a battery 28 that is also mounted within housing 14. A push-button switch 30 and a timing circuit 32 are connected to leads 26 such that, when switch 30 is pressed and released by a user of device 10, motor 24 is energized to rotate drive shaft 20 for a predetermined period of time, say, fifteen seconds.

Reservoir 18 has a rectangular container 34 sized to hold at least two fluid ounces of cleaning solution 36; enough to remove the fingernail polish from ten fingernails of a single user. As shown, container 34 is integrally formed with the top of housing 14. Container 34 has an open top, into which cleaning solution 36 can be poured, that is closed by a removable lid 38. Affixed to lid 38 is a spout 45 that extends forwardly from container 34 toward spindle 16.

Reservoir 18 is provided with a liquid pump 40 that is located at the bottom of container 34. Pump 40 has an open inlet 42 for receiving cleaning solution 36 poured into container 34. Pump 40 has an outlet 44 that is connected by means of a flexible hose 46 to spout 45. When switch 30 is pressed and released by a user so as to energize motor 24, pump 40 is also energized through timing circuit 32 for about five seconds to cause a predetermined quantity of cleaning solution 36, perhaps one fluid ounce, in container 34 to flow from spout 45. If desired, a manually adjustable valve (not shown) can be associated with spout 45 or hose 46 that finely adjusts the flow of cleaning solution 36 from spout 45.

A drum 48 is removably positioned upon base 12. Drum 48 has a circular bottom wall 50 from the periphery of which a cylindrical side wall 52 extends upwardly. A central opening 54 is provided in bottom wall 50 for loosely receiving spindle 16. A tubular sleeve 56 surrounds opening 54 and spindle 16 and extends upwardly toward the open top of drum 48. When base 12 and drum 48 are properly engaged, the polygonal key 22 atop of drive shaft 20 extends upwardly from both spindle 16 and sleeve 56.

A pair of L-shaped rails 58 is integrally formed with side wall 52. Rails 58 extend from the bottom to the top of side wall 52 and are disposed between side wall 52 and sleeve 56. The free ends of rails 58 project inwardly toward one another so as to define a pair of opposed slots 60. The tops of slots 60 are capped or blocked by integral bumpers 62.

A wiper 64 is movably connected to drum 48. Wiper 64 has a plunge bar 66 and a wiper bar 68 that are connected at their respective tops by a crosspiece 70. Bars 66 and 68 have lengths substantially equal to the height of a sponge 72 positioned in drum 48 and described more fully hereinbelow. A pair of retaining pins 74 extends outwardly from the bottom of plunge bar 66 that are configured to slide up and down and pivot within slots 60 yet are prevented from withdrawal from slots 60 by bumpers 62. Crosspiece 70, however, has a length sufficient to suspend wiper bar 68 approximately midway between side wall 52 and sleeve 56. The back of wiper bar 68 tapers in width toward plunge bar 66 for smooth engagement with sponge 72.

A sealing ring 76 prevents the splashing of cleaning solution 36 into the top of spindle 16. As shown, ring 76 is snugly fitted upon polygonal key 22 so as to rotate with drive shaft 20. Ring 76 has an outer diameter sufficient to cover the top of spindle 16 yet not engage sleeve 56 of drum 48.

A carriage 78 rests upon sealing ring 76. Carriage 78 includes a hub 80 having a central opening 82 of polygonal outline that is sized to snugly, yet releasably, receive key 22. Radiating outwardly from hub 80 at ninety degree intervals are four carriage arms 84. Each of arms 84 has four segments 86, 88, 90 and 92 with: the first segment 86 extending outwardly from hub 80, the second segment 88 extending vertically downward from the outer end of first segment 86, the third segment 90 extending horizontally from the outer/bottom end of second segment 88, and the fourth segment 92 extending vertically upward from the outer end of third segment 90. Segments 86, 88, 90 and 92 are sized such that, when carriage 78 is positioned on drive shaft 20, segments 88 are located closely adjacent sleeve 56 to minimize the likelihood of contact with the fingernails 94 of a user's hand 96 and segments 90 are located near the bottom wall 50 of drum 48.

Sponge 72 is fitted atop carriage 78 and is rotated thereby. Sponge 72 has a thick circular band 98 that is supported from below by the third segments 90 of carriage arms 84. Four bores 100, positioned at ninety degree intervals about the circumference of band 98, receive the fourth segments 92 of carriage arms 84. Radiating inwardly from band 98 is a plurality of teeth 102 for scrubbing a user's fingernails 94. Teeth 102 are dimensioned such that, as they are rotated past the tapered back of wiper bar 68, they are compressed to squeeze dirty cleaning solution 36 therefrom. This dirty cleaning solution 36 runs down the exterior of wiper bar 68 and collects in the bottom of drum 48 beneath carriage 78 for disposal after device 10 is used.

A handrest 104 caps drive shaft 20 to support hand 96 during the use of device 10. Handrest 104 includes a bottom part 106 and a top part 108 that are rotatably connected together. Bottom part 106 that rests upon hub 80 of carriage 78 and snugly receives the top of polygonal key 22. Bearings 110 support top part 108 atop bottom part 106 and ensure that, when drive shaft 20 rotates bottom part 106 during normal use of device 10, the orientation of top part 108 remains constant to support hand 96 without twisting.

With device 10 in a disassembled and drained state, a user first lifts lid 38 from container 34 and fills reservoir 18 with cleaning solution 36. Then, drum 48 is set upon base 12 with spindle 16 extending upwardly through sleeve 56. Now, ring 76 is set atop drive shaft 20. Next, sponge 72 is positioned on carriage 78 with arm segments 92 being inserted into bores 100. Afterward, hub 80 of carriage 78 is set upon key 22. Wiper 64 is subsequently pivoted and pressed downwardly such that wiper blade 68 engages adjacent sponge teeth 102. Finally, lid 38 is replaced atop container 34 and handrest 104 is set into place on key 22. Device 10 is now ready to remove polish from the fingernails of fingers 94.

Removing fingernail polish from fingernails is simple. First, a user places the palm of her hand 96 atop handrest 104 and pushes her fingers 94 between sponge teeth 102 and sleeve 56. Next, switch 30 is momentarily pressed thereby energizing pump 40 and motor 24. Pump 40 causes cleaning solution 36 is to be squirted from spout 45 for a few seconds and motor 24 causes sponge 72 to be rotated for a time. As sponge 72 rotates with carriage 78, teeth 102 sweep fingernails with cleaning solution 36 so as to dissolve fingernail polish on the fingernails. After making three to ten revolutions, teeth 102 of sponge 72 typically remove all of the fingernail polish.

After teeth 102 sweep over all five fingernails, teeth 102 squeeze past wiper bar 68 for automatic cleaning. Wiper bar 68 compresses teeth 102 to squeeze the polish-laden cleaning solution 36 therefrom. This dirty solution 36 runs from sponge 72 and collects at the bottom of drum 48. Drum 48 is removed periodically from base 12 and drained.

The just-squeezed teeth 102 rotate past spout 45 that, depending upon settings made in timing circuit 32, deposits fresh cleaning solution 36 on teeth 102. Cleaning solution 36 is driven through spout 45 by pump 40. Spout 45 releases cleaning solution 36 only after the dirty solution 36 has been squeezed from teeth 102. Thus, fingernail cleaning proceeds with maximum speed and with minimal fouling of sponge 72 and the fingers 94 of a user.

To remove artificial fingernails formed of acrylic or silk, a user need only pour enough cleaning solution 36 into reservoir 18 to drench her fingernails. As sponge 72 rotates, it deposits cleaning solution 36 on the artificial fingernails and dissolves them. Sponge 72 continues to rotate until all of artificial fingernails have been removed from fingers 94 of a user.

Device 10 is easily cleaned up after use. First, drum 48 is lifted from base 12 and wiper 64 is pivoted to the side to free sponge 72. Then, sponge 72 is pulled from carriage 78 and washed in soap and water or discarded if considered to be disposable by a particular user. Next, drum 48 is drained of any dirty cleaning solution 36 and washed along with carriage 78 and handrest 104. Base 12 is wiped down, if necessary. After subsequent reassembly, device 10 is available for immediate, hygienic reuse.

Since device 10 is powered by low-voltage storage batteries as at 28, it can be used practically anywhere. Its small size lends itself for storage in suitcases; so, it can be easily transported for use during out-of-town trips. Once back home, device 10 can be easily stored in a drawer for convenient access. Professional salons, however, may choose to leave devices 10 on countertops for quick access and to show clients that the most up-to-date equipment is available to satisfy client needs. Since access to electrical outlets is not required to use device 10, tripping over extension cords is never a problem.

While device 10 has been described with a high degree of particularity, it will be appreciated by those skilled in the art that modifications can be made to it. Therefore, it is to be understood that my invention is not limited merely to device 10 described above, but encompasses any and all similar devices within the scope of the following claims.

I claim:

1. A fingernail polish removing device, comprising:

a motor having a drive shaft extending upwardly therefrom;

a drum being positioned above said motor and having an opening in the bottom thereof for receiving said drive shaft;

a carriage being positioned within said drum and being secured to said drive shaft for rotation therewith;

a sponge being supported by said carriage for rotation therewith, said sponge having a circular band positioned around said drive shaft and a plurality of teeth pointing inwardly from said circular band toward said drive shaft;

a handrest being positioned atop said drive shaft for supporting the hand of a user while her fingernails are extended downwardly into said drum and engaged with said teeth; and, a wiper being secured to said drum and having a wiper bar disposed between said circular band and said drive shaft for sequentially compressing said teeth as said sponge is rotated by said carriage so as to squeeze dirty cleaning solution from said sponge for collection in the bottom of said drum.

2. The device according to claim 1 further comprising:

a container for holding fingernail cleaning solution being positioned adjacent said drum;

a pump being connected to said container for drawing fingernail cleaning solution from said container;

a spout being connected to said pump and being positioned above said sponge for delivering cleaning solution to said teeth.

3. A fingernail polish removing device, comprising:

a base having a hollow spindle extending upwardly therefrom;

an electric motor being positioned within said base and having a drive shaft extending upwardly through said hollow spindle;

a drum being removably positioned upon said base, said drum having an opening in the bottom thereof and a sleeve extending upwardly from the periphery of said opening for receiving said spindle;

a carriage being positioned within said drum and being secured to the top of said drive shaft for rotation therewith;

a sponge being supported by said carriage for rotation therewith, said sponge having a circular band positioned around said sleeve and a plurality of teeth pointing inwardly from said circular band toward said sleeve;

a handrest being positioned atop said drive shaft for supporting the hand of a user while her fingernails are extended downwardly into said drum and engaged with said teeth;

a wiper being secured to said drum, said wiper having a wiper bar disposed between said circular band and said drive shaft for sequentially compressing said teeth as said sponge is rotated by said carriage so as to squeeze dirty cleaning solution from said sponge for collection in the bottom of said drum;

a container for holding fingernail cleaning solution being secured to said base and being positioned adjacent to said drum;

an electric pump being connected to said container for drawing fingernail cleaning solution from said container;

a spout being connected to said pump and being positioned above said sponge for delivering cleaning solution to said teeth; and, a battery being selectively connected to said motor and said pump for energizing same.

* * * * *